US009702029B2

(12) United States Patent
Fripp et al.

(10) Patent No.: US 9,702,029 B2
(45) Date of Patent: Jul. 11, 2017

(54) DEGRADABLE DOWNHOLE TOOLS COMPRISING MAGNESIUM ALLOYS

(71) Applicant: Halliburton Energy Services, Inc., Houston, TX (US)

(72) Inventors: Michael Linley Fripp, Carrollton, TX (US); Zachary William Walton, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/783,479

(22) PCT Filed: Jun. 30, 2015

(86) PCT No.: PCT/US2015/038573

§ 371 (c)(1),
(2) Date: Oct. 9, 2015

(87) PCT Pub. No.: WO2016/032619

PCT Pub. Date: Mar. 3, 2016

(65) Prior Publication Data

US 2016/0230494 A1 Aug. 11, 2016

Related U.S. Application Data

(63) Continuation-in-part of application No. PCT/US2014/053185, filed on Aug. 28, 2014.

(51) Int. Cl.
*E21B 29/02* (2006.01)
*C22C 23/02* (2006.01)
(Continued)

(52) U.S. Cl.
CPC ..... *C22C 23/02* (2013.01); *C22C 23/04* (2013.01); *E21B 33/12* (2013.01); *E21B 33/134* (2013.01);
(Continued)

(58) Field of Classification Search
CPC ..... E21B 29/00; E21B 29/02; C22C 23/00; C22C 23/02; C22C 23/04; C22C 23/06
(Continued)

(56) References Cited

U.S. PATENT DOCUMENTS 5,336,466 A * 8/1994 Iba ..... C22C 23/02 420/405
5,342,576 A * 8/1994 Whitehead ..... A61K 9/0068 148/420
(Continued)

FOREIGN PATENT DOCUMENTS

WO 2016032490 A1 3/2016
WO 2016032619 A1 3/2016
(Continued)

OTHER PUBLICATIONS

International Search Report and Written Opinion for PCT/US2014/050993 dated May 13, 2015.
(Continued)

*Primary Examiner* — Kenneth L Thompson
(74) *Attorney, Agent, or Firm* — McDermott Will & Emery LLP

(57) ABSTRACT

Downhole tools having at least one component made of a doped magnesium alloy solid solution that at least partially degrades in the presence of an electrolyte, wherein the doped magnesium alloy is selected from the group consisting of a doped MG magnesium alloy, a doped WE magnesium alloy, a doped AZ magnesium alloy, a doped ZK magnesium alloy, a doped AM magnesium alloy, and any combination thereof.

19 Claims, 3 Drawing Sheets

(51) Int. Cl.

| | |
|---|---|
| ***E21B 33/134*** | (2006.01) |
| ***E21B 41/00*** | (2006.01) |
| ***C22C 23/04*** | (2006.01) |
| ***E21B 33/12*** | (2006.01) |
| *E21B 23/01* | (2006.01) |
| *E21B 34/06* | (2006.01) |
| *E21B 43/116* | (2006.01) |
| *E21B 43/25* | (2006.01) |
| *E21B 43/26* | (2006.01) |

(52) U.S. Cl.
CPC ..... *E21B 41/00* (2013.01); *E21B 23/01* (2013.01); *E21B 34/06* (2013.01); *E21B 43/116* (2013.01); *E21B 43/25* (2013.01); *E21B 43/26* (2013.01)

(58) Field of Classification Search
USPC ..... 166/376; 420/402–414; 148/420
See application file for complete search history.

(56) References Cited

U.S. PATENT DOCUMENTS

| | | | | |
|---|---|---|---|---|
| 5,552,110 | A * | 9/1996 | Iba | C22C 23/04 420/405 |
| 7,168,494 | B2 | 1/2007 | Starr et al. | |
| 8,770,261 | B2 * | 7/2014 | Marya | C22C 1/0416 164/55.1 |
| 8,776,884 | B2 * | 7/2014 | Xu | E21B 21/10 166/100 |
| 8,789,610 | B2 * | 7/2014 | Oxford | B22F 1/02 166/242.8 |
| 9,016,384 | B2 * | 4/2015 | Xu | E21B 29/06 166/376 |
| 9,027,655 | B2 * | 5/2015 | Xu | E21B 23/01 166/376 |
| 9,080,439 | B2 * | 7/2015 | O'Malley | E21B 43/261 |
| 2006/0113077 | A1 | 6/2006 | Willberg et al. | |
| 2007/0181224 | A1 | 8/2007 | Marya et al. | |
| 2008/0149351 | A1 | 6/2008 | Marya et al. | |
| 2008/0175744 | A1 * | 7/2008 | Motegi | C22C 23/02 420/409 |
| 2011/0048743 | A1 | 3/2011 | Stafford et al. | |
| 2011/0067889 | A1 | 3/2011 | Marya et al. | |
| 2012/0273229 | A1 | 11/2012 | Xu et al. | |
| 2012/0318513 | A1 | 12/2012 | Mazyar et al. | |
| 2013/0043041 | A1 | 2/2013 | McCoy et al. | |
| 2013/0047785 | A1 * | 2/2013 | Xu | C22C 23/04 75/232 |
| 2013/0327540 | A1 | 12/2013 | Hamid et al. | |
| 2014/0027128 | A1 * | 1/2014 | Johnson | B22F 1/02 166/376 |
| 2014/0202708 | A1 | 7/2014 | Jacob et al. | |
| 2014/0286810 | A1 * | 9/2014 | Marya | C22C 1/0416 419/10 |
| 2016/0024619 | A1 * | 1/2016 | Wilks | E21B 34/063 166/308.1 |
| 2016/0201425 | A1 * | 7/2016 | Walton | E21B 33/134 166/376 |
| 2016/0201427 | A1 * | 7/2016 | Fripp | E21B 33/134 166/297 |
| 2016/0201435 | A1 * | 7/2016 | Fripp | E21B 33/12 166/376 |
| 2016/0230498 | A1 * | 8/2016 | Walton | E21B 33/12 |
| 2016/0251934 | A1 * | 9/2016 | Walton | E21B 33/12 |
| 2016/0265091 | A1 * | 9/2016 | Walton | E21B 33/134 |

FOREIGN PATENT DOCUMENTS

| | | | |
|---|---|---|---|
| WO | 2016032758 | A1 | 3/2016 |
| WO | 2016036371 | A1 | 3/2016 |

OTHER PUBLICATIONS

Standard Practice for Codification of Certain Nonferrous Metals and Alloys, Case and Wrought, ASTM International Designations: B275-13E1, 2014.

Search Report received in corresponding Netherlands Application No. 1041450, dated Jun. 27, 2016.

* cited by examiner

DEGRADABLE DOWNHOLE TOOLS COMPRISING MAGNESIUM ALLOYS

CROSS-REFERENCE TO RELATED APPLICATIONS

This application claims priority to PCT/US2014/053185 filed on Aug. 28, 2014 and entitled "Degradable Downhole Tools Comprising Magnesium Alloys."

BACKGROUND

The present disclosure relates to downhole tools used in the oil and gas industry and, more particularly, to degradable downhole tools comprising doped magnesium alloy solid solutions.

In the oil and gas industry, a wide variety of downhole tools are used within a wellbore in connection with producing hydrocarbons or reworking a well that extends into a hydrocarbon producing subterranean formation. For examples, some downhole tools, such as fracturing plugs (i.e., "frac" plugs), bridge plugs, and packers, may be used to seal a component against casing along a wellbore wall or to isolate one pressure zone of the formation from another.

After the production or reworking operation is complete, the downhole tool must be removed from the wellbore, such as to allow for production or further operations to proceed without being hindered by the presence of the downhole tool. Removal of the downhole tool(s) is traditionally accomplished by complex retrieval operations involving milling or drilling the downhole tool for mechanical retrieval. In order to facilitate such operations, downhole tools have traditionally been composed of drillable metal materials, such as cast iron, brass, or aluminum. These operations can be costly and time consuming, as they involve introducing a tool string (e.g., a mechanical connection to the surface) into the wellbore, milling or drilling out the downhole tool (e.g., breaking a seal), and mechanically retrieving the downhole tool or pieces thereof from the wellbore to bring to the surface.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

Figure 1:
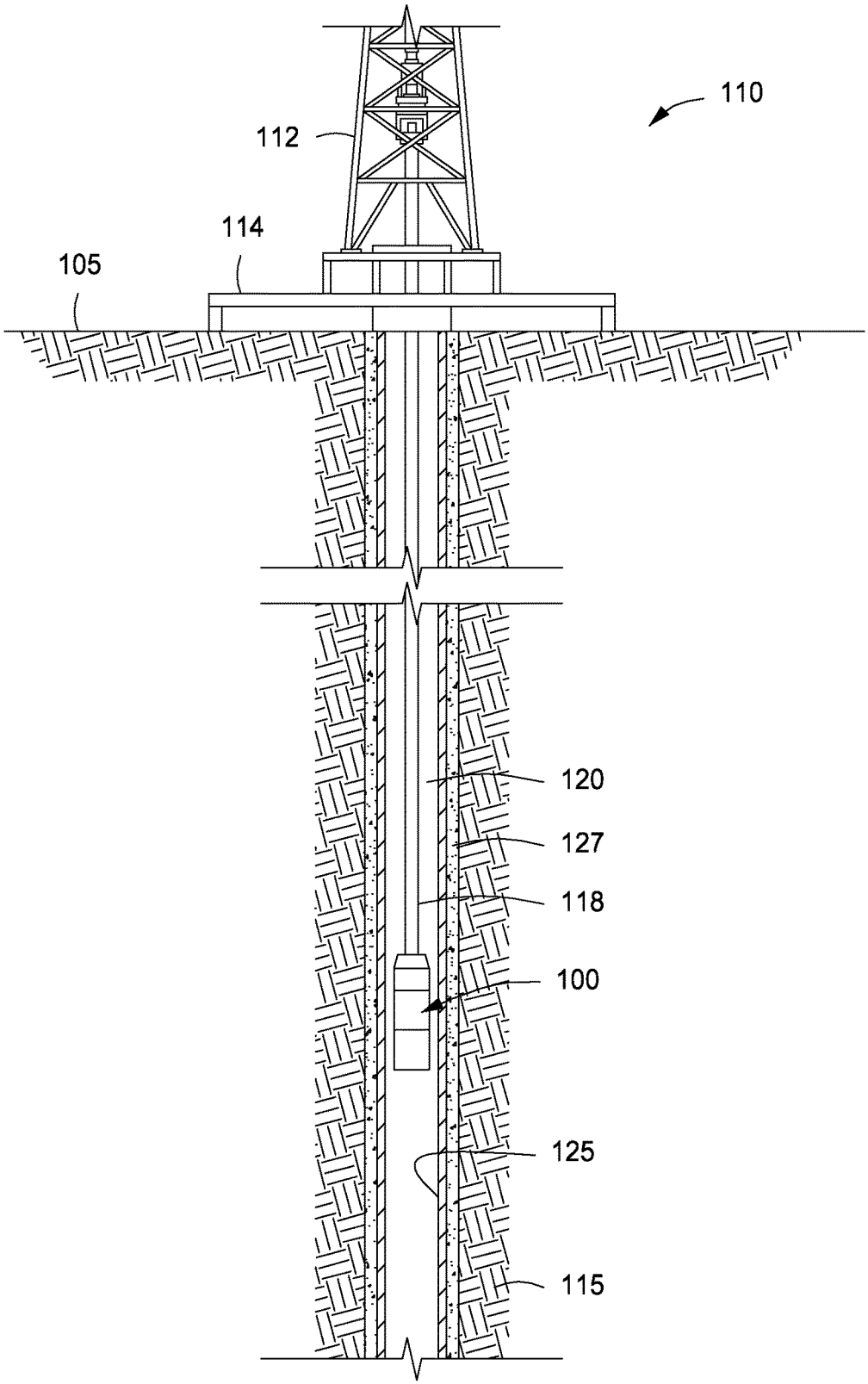
FIG. 1 is a well system that can employ one or more principles of the present disclosure, according to one or more embodiments.

The present disclosure relates to downhole tools used in the oil and gas industry and, more particularly, to degradable downhole tools comprising doped magnesium alloy solid solutions (also referred to herein simply as "doped magnesium alloys").

One or more illustrative embodiments disclosed herein are presented below. Not all features of an actual implementation are described or shown in this application for the sake of clarity. It is understood that in the development of an actual embodiment incorporating the embodiments disclosed herein, numerous implementation-specific decisions must be made to achieve the developer's goals, such as compliance with system-related, lithology-related, business-related, government-related, and other constraints, which vary by implementation and from time to time. While a developer's efforts might be complex and time-consuming, such efforts would be, nevertheless, a routine undertaking for those of ordinary skill in the art having benefit of this disclosure.

It should be noted that when "about" is provided herein at the beginning of a numerical list, the term modifies each number of the numerical list. In some numerical listings of ranges, some lower limits listed may be greater than some upper limits listed. One skilled in the art will recognize that the selected subset will require the selection of an upper limit in excess of the selected lower limit. Unless otherwise indicated, all numbers expressing quantities of ingredients, properties such as molecular weight, reaction conditions, and so forth used in the present specification and associated claims are to be understood as being modified in all instances by the term "about." As used herein, the term "about" encompasses +/−5% of each numerical value. For example, if the numerical value is "about 80%," then it can be 80%+/−5%, equivalent to 76% to 84%. Accordingly, unless indicated to the contrary, the numerical parameters set forth in the following specification and attached claims are approximations that may vary depending upon the desired properties sought to be obtained by the exemplary embodiments described herein. At the very least, and not as an attempt to limit the application of the doctrine of equivalents to the scope of the claim, each numerical parameter should at least be construed in light of the number of reported significant digits and by applying ordinary rounding techniques.

While compositions and methods are described herein in terms of "comprising" various components or steps, the compositions and methods can also "consist essentially of" or "consist of" the various components and steps. When "comprising" is used in a claim, it is open-ended.

As used herein, the term "substantially" means largely, but not necessarily wholly.

The use of directional terms such as above, below, upper, lower, upward, downward, left, right, uphole, downhole and the like, are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

The downhole tools described herein include one or more components comprised of doped magnesium alloys in a solid solution capable of degradation by galvanic corrosion in the presence of an electrolyte, where the presence of the dopant accelerates the corrosion rate compared to a similar magnesium alloy without a dopant. The downhole tools of the present disclosure may include multiple structural components that may each be composed of the magnesium alloys described herein. For example, in one embodiment, a downhole tool may comprise at least two components, each made of the same doped magnesium alloy or each made of different doped magnesium alloys. In other embodiments, the downhole tool may comprise more than two components that may each be made of the same or different doped magnesium alloys. Moreover, it is not necessary that each component of a downhole tool be composed of a doped magnesium alloy, provided that the downhole tool is capable of sufficient degradation for use in a particular downhole operation. Accordingly, one or more components of the downhole tool may have different degradation rates based on the type of doped magnesium alloy selected.

As used herein, the term "degradable" and all of its grammatical variants (e.g., "degrade," "degradation," "degrading," and the like) refer to the dissolution, galvanic conversion, or chemical conversion of solid materials such that a reduced structural integrity results. In complete degradation, structural shape is lost. The doped magnesium alloy solid solutions described herein may degrade by galvanic corrosion in the presence of an electrolyte. As used herein, the term "electrolyte" refers to a conducting medium containing ions (e.g., a salt). The term "galvanic corrosion" refers to corrosion occurring when two different metals or metal alloys are in electrical connectivity with each other and both are in contact with an electrolyte. The term "galvanic corrosion" includes microgalvanic corrosion. As used herein, the term "electrical connectivity" means that the two different metals or metal alloys are either touching or in close proximity to each other such that when contacted with an electrolyte, the electrolyte becomes electrically conductive and ion migration occurs between one of the metals and the other metal.

In some instances, the degradation of the doped magnesium alloy may be sufficient for the mechanical properties of the material to be reduced to a point that the material no longer maintains its integrity and, in essence, falls apart or sloughs off. The conditions for degradation are generally wellbore conditions in a wellbore environment where an external stimulus may be used to initiate or affect the rate of degradation. For example, a fluid comprising the electrolyte may be introduced into a wellbore to initiate degradation. In another example, the wellbore may naturally produce the electrolyte sufficient to initiate degradation. The term "wellbore environment" refers to a subterranean location within a wellbore, and includes both naturally occurring wellbore environments and materials or fluids introduced into the wellbore environment. Degradation of the degradable materials identified herein may be anywhere from about 4 hours (hrs) to about 576 hrs (or about 4 hours to about 24 days) from first contact with the appropriate wellbore environment, encompassing any value and subset therebetween. Each of these values is critical to the embodiments of the present disclosure and may depend on a number of factors including, but not limited to, the magnesium alloy selected, the dopant selected, the amount of dopant selected, and the like. In some embodiments, the degradation rate of the doped magnesium alloys described herein may be accelerated based on conditions in the wellbore or conditions of the wellbore fluids (either natural or introduced) including temperature, pH, salinity, pressure, and the like.

In some embodiments, the electrolyte capable of degrading the doped magnesium alloys described herein may be a halide anion (i.e., fluoride, chloride, bromide, iodide, and astatide), a halide salt, an oxoanion (including monomeric oxoanions and polyoxoanions), and any combination thereof. Suitable examples of halide salts for use as the electrolytes of the present disclosure may include, but are not limited to, a potassium fluoride, a potassium chloride, a potassium bromide, a potassium iodide, a sodium chloride, a sodium bromide, a sodium iodide, a sodium fluoride, a calcium fluoride, a calcium chloride, a calcium bromide, a calcium iodide, a zinc fluoride, a zinc chloride, a zinc bromide, a zinc iodide, an ammonium fluoride, an ammonium chloride, an ammonium bromide, an ammonium iodide, a magnesium chloride, potassium carbonate, potassium nitrate, sodium nitrate, and any combination thereof. The oxyanions for use as the electrolyte of the present disclosure may be generally represented by the formula $A_xO_y^{z-}$, where A represents a chemical element and O is an oxygen atom; x, y, and z are integers between the range of about 1 to about 30, and may be or may not be the same integer. Examples of suitable oxoanions may include, but are not limited to, carbonate, borate, nitrate, phosphate, sulfate, nitrite, chlorite, hypochlorite, phosphite, sulfite, hypophosphite, hyposulfite, triphosphate, and any combination thereof.

In some embodiments, the electrolyte may be present in an aqueous base fluid including, but not limited to, fresh water, saltwater (e.g., water containing one or more salts dissolved therein), brine (e.g., saturated salt water), seawater, and any combination thereof. Generally, the water in the aqueous base fluid may be from any source, provided that it does not interfere with the electrolyte therein from degrading at least partially the magnesium alloy forming at least a component of the downhole tool described herein. In some embodiments, the electrolyte may be present in the aqueous base fluid for contacting the magnesium alloy in a subterranean formation up to saturation, which may vary depending on the magnesium salt and aqueous base fluid selected. In other embodiments, the electrolyte may be present in the aqueous base fluid for contacting the magnesium alloy in a subterranean formation in an amount in the range of from about 0.01% to about 30% by weight of the treatment fluid, encompassing any value and subset therebetween. Each of these values is critical to the embodiments of the present disclosure and may depend on a number of factors including, but not limited to, the composition of the doped magnesium alloy, the portion of the downhole tool composed of the doped magnesium alloy, the type of electrolyte selected, other conditions of the wellbore environment, and the like. As used herein the term "degrading at least partially" or "partially degrades" refers to the tool or component degrading at least to the point wherein about 20% or more of the mass of the tool or component degrades.

Referring now to FIG. 1, illustrated is an exemplary well system 110 for a downhole tool 100. As depicted, a derrick 112 with a rig floor 114 is positioned on the earth's surface 105. A wellbore 120 is positioned below the derrick 112 and the rig floor 114 and extends into subterranean formation 115. As shown, the wellbore may be lined with casing 125 that is cemented into place with cement 127. It will be appreciated that although FIG. 1 depicts the wellbore 120 having a casing 125 being cemented into place with cement 127, the wellbore 120 may be wholly or partially cased and wholly or partially cemented (i.e., the casing wholly or partially spans the wellbore and may or may not be wholly or partially cemented in place), without departing from the scope of the present disclosure. Moreover, the wellbore 120 may be an open-hole wellbore. A tool string 118 extends from the derrick 112 and the rig floor 114 downwardly into the wellbore 120. The tool string 118 may be any mechanical connection to the surface, such as, for example, wireline, slickline, jointed pipe, or coiled tubing. As depicted, the tool string 118 suspends the downhole tool 100 for placement into the wellbore 120 at a desired location to perform a specific downhole operation. Examples of such downhole operations may include, but are not limited to, a stimulation operation, an acidizing operation, an acid-fracturing operation, a sand control operation, a fracturing operation, a frac-packing operation, a remedial operation, a perforating operation, a near-wellbore consolidation operation, a drilling operation, a completion operation, and any combination thereof.

In some embodiments, the downhole tool 100 may comprise one or more components, one or all of which may be composed of a degradable doped magnesium alloy solid solution (i.e., all or at least a portion of the downhole tool 100 may be composed of a magnesium alloy described herein). In some embodiments, the downhole tool 100 may be any type of wellbore isolation device capable of fluidly sealing two sections of the wellbore 120 from one another and maintaining differential pressure (i.e., to isolate one pressure zone from another). The wellbore isolation device may be used in direct contact with the formation face of the wellbore, with casing string, with a screen or wire mesh, and the like. Examples of suitable wellbore isolation devices may include, but are not limited to, a frac plug, a frac ball, a setting ball, a bridge plug, a wellbore packer, a wiper plug, a cement plug, a basepipe plug, a sand screen plug, an inflow control device (ICD) plug, an autonomous ICD plug, a tubing section, a tubing string, and any combination thereof. In some embodiments, the downhole tool 100 may be a completion tool, a drill tool, a testing tool, a slickline tool, a wireline tool, an autonomous tool, a tubing conveyed perforating tool, and any combination thereof. The downhole tool 100 may have one or more components made of the doped magnesium alloy including, but not limited to, the mandrel of a packer or plug, a spacer ring, a slip, a wedge, a retainer ring, an extrusion limiter or backup shoe, a mule shoe, a ball, a flapper, a ball seat, a sleeve, a perforation gun housing, a cement dart, a wiper dart, a sealing element, a wedge, a slip block (e.g., to prevent sliding sleeves from translating), a logging tool, a housing, a release mechanism, a pumpdown tool, an inflow control device plug, an autonomous inflow control device plug, a coupling, a connector, a support, an enclosure, a cage, a slip body, a tapered shoe, or any other downhole tool or component thereof.

The doped magnesium alloys for use in forming a first or second (or additional) component of the downhole tool 100 may be in the form of a solid solution. As used herein, the term "solid solution" refers to an alloy that is formed from a single melt where all of the components in the alloy (e.g., a magnesium alloy) are melted together in a casting. The casting can be subsequently extruded, wrought, hipped, or worked. Preferably, the magnesium and the at least one other ingredient (e.g., the dopant, rare earth metals, or other materials, as discussed below) are uniformly distributed throughout the magnesium alloy, although intra-granular inclusions may also be present, without departing from the scope of the present disclosure. It is to be understood that some minor variations in the distribution of particles of the magnesium and the at least one other ingredient can occur, but that it is preferred that the distribution is such that a solid solution of the metal alloy occurs. In some embodiments, the magnesium and at least one other ingredient in the doped magnesium alloys described herein are in a solid solution, wherein the addition of a dopant results in intra-granular inclusions being formed.

The dopant is in solution with the magnesium alloy to form the doped magnesium alloys of the present disclosure. During fabrication, the dopant may be added as part of a master alloy. For example, the dopant may be added to one of the alloying elements prior to mixing all of the other alloys and magnesium. For example, during the fabrication of an AZ alloy, discussed in detail below, the dopant (e.g., iron) may be dissolved in aluminum, followed by mixing with the remaining alloy, magnesium, and other components if present. Additional amounts of the aluminum may be added after dissolving the dopant, as well, without departing from the scope of the present disclosure, in order to achieve the desired composition. Suitable dopants for use in forming the doped magnesium alloys described herein may include, but are not limited to, iron, copper, nickel, chromium, cobalt, carbon, silver, gold, palladium, and any combination thereof. In some embodiments, iron, copper, nickel, and any combination thereof may be a preferred dopant.

In some embodiments, the doped magnesium alloy forming at least one of the first components or second components (or any additional components) of a downhole tool 100 may be one of a doped MG magnesium alloy, a doped WE magnesium alloy, a doped AZ magnesium alloy, a doped AM magnesium alloy, or a doped ZK magnesium alloy. As defined herein, a "doped MG magnesium alloy" is an alloy comprising at least magnesium, dopant, and optional supplemental material, as defined herein; a "doped WE magnesium alloy" is an alloy comprising at least a rare earth metal, magnesium, dopant, and optional supplemental material, as defined herein; a "doped AZ magnesium alloy" is an alloy comprising at least aluminum, zinc, magnesium, dopant, and optional supplemental material, as defined herein; a "doped AM magnesium" is an alloy comprising at least aluminum, manganese, magnesium, dopant, and optional supplemental material, as defined herein; and a "ZK magnesium alloy" is an alloy comprising at least zinc, zirconium, magnesium, dopant, and optional supplemental material, as defined herein. Accordingly, any or all of the doped MG magnesium alloy, the doped WE magnesium alloy, the doped AZ magnesium alloy, the doped AM magnesium alloy, or the doped ZK magnesium alloy may comprise a supplemental material, or may have no supplemental material, without departing from the scope of the present disclosure.

As will be discussed in greater detail with reference to an exemplary downhole tool 100 in FIG. 2, each metallic component of the downhole tool 100 may be made of one type of doped magnesium alloy or different types of doped magnesium alloys. For example, some components may be made of a doped magnesium alloy having a delayed degradation rate compared to another component made of a different doped magnesium alloy to ensure that certain portions of the downhole tool 100 degrade prior to other portions.

The doped magnesium alloys described herein exhibit a greater degradation rate compared to non-doped magnesium alloys owing to their specific composition, the presence of the dopant, the presence of inter-granular inclusions, or both. For example, the zinc concentration of a ZK magnesium alloy may vary from grain to grain within the alloy, which produces an inter-granular variation in the galvanic potential. As another example, the dopant in a doped AZ magnesium alloy may lead to the formation of inter-granular inclusions where the inter-granular inclusions have a slightly different galvanic potential than the grains in the alloy. These variations in the galvanic potential may result in increased corrosion, as discussed in greater detail below and depicted in FIG. 3.

The doped magnesium alloys described herein may further comprise an amount of material, termed "supplementary material," that is defined as neither the primary chemical elements of the magnesium alloy or the dopant. This supplementary material may include, but is not limited to, unknown materials, impurities, additives (e.g., those purposefully included to aid in mechanical properties), and any combination thereof. The supplementary material minimally, if at all, effects the acceleration of the corrosion rate of the doped magnesium alloy. Accordingly, the supplementary material may, for example, inhibit the corrosion rate or have no affect thereon. As defined herein, the term "minimally" with reference to the effect of the acceleration rate refers to an effect of no more than about 5% as compared to no supplementary material being present. This supplementary material, discussed in greater detail below, may enter the doped magnesium alloys of the present invention due to natural carry-over from raw materials, oxidation of magnesium or other elements, manufacturing processes (e.g., smelting processes, casting processes, alloying process, and the like), or the like. Alternatively, the supplementary material may be intentionally included additives placed in the doped magnesium alloy to impart a beneficial quality to the alloy, as discussed below. Generally, the supplemental material is present in the doped magnesium alloys described herein in an amount of less than about 10% by weight of the doped magnesium alloy, including no supplemental material at all (i.e., 0%).

Magnesium concentrations in each of the doped magnesium alloys described herein may vary depending on the desired properties of the alloy. Moreover, the type of doped magnesium alloy (e.g., MG, WE, AZ, ZK, and AM) influence the desired amount of magnesium. Moreover, the amount of magnesium, as well as other metals, dopants, and/or other materials may affect the tensile strength, yield strength, elongation, thermal properties, fabrication characteristics, corrosion properties, and the like.

The doped MG magnesium alloys of the present disclosure comprise magnesium in an amount in the range of from about 85% to about 99.95% by weight of the doped MG magnesium alloy, encompassing any value and subset therebetween. Additionally, the doped MG magnesium alloy comprises a dopant in the amount in the range of from about 0.05% to about 15% by weight of the doped MG magnesium alloy. Finally, the doped MG magnesium alloys of the present disclosure may comprise supplementary material, as defined above and discussed below, in an amount in the range of from about 0% to about 10% by weight of the doped MG magnesium alloy, encompassing any value and subset therebetween. That is, in some instances, the doped MG magnesium alloy comprises no supplemental material.

A specific example of a doped MG magnesium alloy for use in forming at least one component of a downhole tool according to the embodiments described herein comprises 85% to 99.95% of magnesium by weight of the doped MG magnesium alloy, 0.05% to 15% dopant by weight of the doped MG magnesium alloy, and 0% to 10% of supplemental material by weight of the doped MG magnesium alloy. In another example, the doped MG magnesium alloy comprises 85% to 99.95% of magnesium by weight of the doped MG magnesium alloy, 0.05% to 5% dopant by weight of the doped MG magnesium alloy, and 0% to 10% of supplemental material by weight of the doped MG magnesium alloy. In preferred embodiments, the dopant is iron, nickel, copper, and any combination thereof. Dopants are discussed in greater detail below.

The doped WE magnesium alloys of the present disclosure may comprise magnesium in an amount in the range of from about 40% to about 98.95% by weight of the doped WE magnesium alloy, encompassing any value and subset therebetween. The doped WE magnesium alloy may further comprise a rare earth metal in an amount in the range of from about 1% to about 15% by weight of the doped WE magnesium alloy, encompassing any value and subset therebetween. The rare earth metal may be selected from the group consisting of scandium, lanthanum, cerium, praseodymium, neodymium, promethium, samarium, europium, gadolinium, dysprosium, holmium, erbium, thulium, ytterbium, lutetium, yttrium, and any combination thereof. In preferred embodiments, the rare earth metal comprises yttrium. Additionally, the doped WE magnesium alloy may comprise a dopant in the amount in the range of from about 0.05% to about 15% by weight of the doped WE magnesium alloy. Finally, the doped WE magnesium alloys of the present disclosure may comprise supplementary material, as defined above and discussed below, in an amount in the range of from about 0% to about 10% by weight of the doped WE magnesium alloy, encompassing any value and subset therebetween. That is, in some instances, the doped WE magnesium alloy comprises no supplemental material.

A specific example of a doped WE magnesium alloy for use forming at least one component of a downhole tool according to the embodiments described herein comprises 40% to 98.95% of magnesium by weight of the doped WE magnesium alloy, 1% to 15% of a rare earth metal by weight of the doped WE magnesium alloy, 0.05% to 15% dopant by weight of the doped WE magnesium alloy, and 0% to 10% of supplemental material by weight of the doped WE magnesium alloy. As another specific example, the doped WE magnesium alloy of the present disclosure comprises 40% to 98.95% of magnesium by weight of the doped WE magnesium alloy, 1% to 15% of a rare earth metal by weight of the doped WE magnesium alloy, 0.5% to 5% dopant by weight of the doped WE magnesium alloy, and 0% to 10% of supplemental material by weight of the doped WE magnesium alloy.

As yet another specific example of a doped WE magnesium alloy for use in forming at least one component of a downhole tool according to the embodiments described herein comprises 88% to 95% of magnesium by weight of the doped WE magnesium alloy, 3% to 5% of yttrium by weight of the doped WE magnesium alloy, 2% to 5% of a rare earth metal that is not yttrium by weight of the doped WE magnesium alloy, and 0.05% to 5% of dopant by weight of the doped WE magnesium alloy. As another specific example, the doped WE magnesium alloy for use in forming at least one component of a downhole tool according to the embodiments described herein comprises 86.6% to 90.6% magnesium by weight of the doped WE magnesium alloy, about 4% yttrium by weight of the doped WE magnesium alloy, about 4% of a rare earth metal that is not yttrium by weight of the doped WE magnesium alloy, 1% to 5% of dopant selected from the group consisting of iron, nickel, copper, and any combination thereof by weight of the doped WE magnesium alloy, and about 0.4% supplemental material of zirconium by weight of the doped WE magnesium alloy.

The doped AZ magnesium alloys of the present disclosure may comprise magnesium in an amount in the range of from about 57.3% to 98.85% of magnesium by weight of the doped AZ magnesium alloy, encompassing any value and subset therebetween. The doped AZ magnesium alloy may further comprise aluminum in an amount in the range of from about 1% to about 12.7% by weight of the doped AZ magnesium alloy, encompassing any value and subset therebetween. The doped AZ magnesium alloy may further comprise zinc in an amount in the range of from about 0.1% to about 5% by weight of the doped AZ magnesium alloy, encompassing any value and subset therebetween. Additionally, the doped AZ magnesium alloy may comprise a dopant in the amount in the range of from about 0.05% to about 15% by weight of the doped WE magnesium alloy. Finally, the doped AZ magnesium alloys of the present disclosure may comprise supplementary material, as defined above and discussed below, in an amount in the range of from about 0% to about 10% by weight of the doped AZ magnesium alloy, encompassing any value and subset therebetween. That is, in some instances, the doped AZ magnesium alloy comprises no supplemental material.

A specific example of a doped AZ magnesium alloy for use forming at least one component of a downhole tool according to the embodiments described herein comprises 57.3% to 98.85% of magnesium by weight of the doped AZ magnesium alloy, 1% to 12.7% aluminum by weight of the doped AZ magnesium alloy, 0.1% to 5% of zinc by weight of the doped AZ magnesium alloy, 0.05% to 15% dopant by weight of the doped AZ magnesium alloy, and 0% to 10% of supplemental material by weight of the doped AZ magnesium alloy. As another specific example, the doped AZ magnesium alloy of the present disclosure comprises 57.3% to 98.85% of magnesium by weight of the doped AZ magnesium alloy, 1% to 12.7% aluminum by weight of the doped AZ magnesium alloy, 0.1% to 5% of zinc by weight of the doped AZ magnesium alloy, 0.5% to 5% dopant by weight of the doped AZ magnesium alloy, and 0% to 10% of supplemental material by weight of the doped AZ magnesium alloy.

In other embodiments, the doped AZ magnesium alloy comprises 57.3% to 98.85% of magnesium by weight of the doped AZ magnesium alloy, 3% to 10% aluminum by weight of the doped AZ magnesium alloy, 0.1% to 5% of zinc by weight of the doped AZ magnesium alloy, 0.05% to 15% dopant by weight of the doped AZ magnesium alloy, and 0% to 10% of supplemental material by weight of the doped AZ magnesium alloy. In some embodiments, the doped AZ magnesium alloy comprises 57.3% to 98.85% of magnesium by weight of the doped AZ magnesium alloy, 3% to 10% aluminum by weight of the doped AZ magnesium alloy, 0.1% to 5% of zinc by weight of the doped AZ magnesium alloy, 0.5% to 5% dopant by weight of the doped AZ magnesium alloy, and 0% to 10% of supplemental material by weight of the doped AZ magnesium alloy.

Other specific examples of the doped AZ magnesium alloy for use as a component of the downhole tools described herein comprise 57.3% to 98.85% of magnesium by weight of the doped AZ magnesium alloy, 1% to 12.7% aluminum by weight of the doped AZ magnesium alloy, 0.1% to 3% of zinc by weight of the doped AZ magnesium alloy, 0.05% to 15% dopant by weight of the doped AZ magnesium alloy, and 0% to 10% of supplemental material by weight of the doped AZ magnesium alloy. The doped AZ magnesium alloy, in some instances, comprises 57.3% to 98.85% of magnesium by weight of the doped AZ magnesium alloy, 1% to 12.7% aluminum by weight of the doped AZ magnesium alloy, 0.1% to 3% of zinc by weight of the doped AZ magnesium alloy, 0.5% to 5% dopant by weight of the doped AZ magnesium alloy, and 0% to 10% of supplemental material by weight of the doped AZ magnesium alloy.

Another specific example of the doped AZ magnesium alloy comprises 57.3% to 98.85% of magnesium by weight of the doped AZ magnesium alloy, 3% to 10% aluminum by weight of the doped AZ magnesium alloy, 0.1% to 3% of zinc by weight of the doped AZ magnesium alloy, 0.05% to 15% dopant by weight of the doped AZ magnesium alloy, and 0% to 10% of supplemental material by weight of the doped AZ magnesium alloy. Additionally, the doped AZ magnesium alloy in some embodiments comprises 57.3% to 98.85% of magnesium by weight of the doped AZ magnesium alloy, 3% to 10% aluminum by weight of the doped AZ magnesium alloy, 0.1% to 3% of zinc by weight of the doped AZ magnesium alloy, 0.5% to 5% dopant by weight of the doped AZ magnesium alloy, and 0% to 10% of supplemental material by weight of the doped AZ magnesium alloy. In other embodiments, the doped AZ magnesium alloy comprises 87% to 97% of magnesium by weight of the doped AZ magnesium alloy, 3% to 10% of aluminum by weight of the doped AZ magnesium alloy, 0.3% to 3% of zinc by weight of the doped AZ magnesium alloy, and 0.05% to 5% of dopant by weight of the doped AZ magnesium alloy.

In another embodiment, the doped AZ magnesium alloy comprises about 88.5% magnesium by weight of the doped AZ magnesium alloy, about 9% aluminum by weight of the doped AZ magnesium alloy, about 0.7% zinc by weight of the doped AZ magnesium alloy, about 1% to about 5% dopant selected from the group consisting of iron, nickel, copper, and any combination thereof by weight of the doped AZ magnesium alloy, about 0.2% supplemental material of manganese by weight of the doped AZ magnesium alloy, and about 0.3% supplemental material of silicon by weight of the doped AZ magnesium alloy. In yet another embodiment, the doped AZ magnesium alloy comprises about 94.5% magnesium by weight of the doped AZ magnesium alloy, about 3% aluminum by weight of the doped AZ magnesium alloy, about 1% zinc by weight of the doped AZ magnesium alloy, about 1% to about 5% dopant selected from the group consisting of iron, nickel, copper, and any combination thereof by weight of the doped AZ magnesium alloy, and about 0.3% supplemental material of manganese by weight of the doped AZ magnesium alloy.

The doped ZK magnesium alloys of the present disclosure may comprise magnesium in an amount in the range of from about 58% to about 98.95% by weight of the doped ZK magnesium alloy, encompassing any value and subset therebetween. The doped ZK magnesium alloy may further comprise zinc in an amount in the range of from about 1% to about 12% by weight of the doped ZK magnesium alloy, encompassing any value and subset therebetween. The doped ZK magnesium alloy may further comprise zirconium in an amount in the range of from about 0.01% to about 5% by weight of the doped ZK magnesium alloy, encompassing any value and subset therebetween. Additionally, the doped ZK magnesium alloy may comprise a dopant in the amount in the range of from about 0.05% to about 15% by weight of the doped ZK magnesium alloy. Finally, the doped ZK magnesium alloys of the present disclosure may comprise supplementary material, as defined above and discussed below, in an amount in the range of from about 0% to about 10% by weight of the doped ZK magnesium alloy, encompassing any value and subset therebetween. That is, in some instances, the doped ZK magnesium alloy comprises no supplemental material.

A specific example of a doped ZK magnesium alloy for use forming at least one component of a downhole tool according to the embodiments described herein comprises 58% to 98.95% of magnesium by weight of the doped ZK magnesium alloy, 1% to 12% of zinc by weight of the doped ZK magnesium alloy, 0.01% to 5% of zirconium by weight of the doped ZK magnesium alloy, 0.05% to 15% dopant by weight of the doped ZK magnesium alloy, and 0% to 10% of supplemental material by weight of the doped ZK magnesium alloy. As another specific example, the doped WE magnesium alloys of the present disclosure comprises 58% to 98.95% of magnesium by weight of the doped ZK magnesium alloy, 1% to 12% of zinc by weight of the doped ZK magnesium alloy, 0.01% to 5% of zirconium by weight of the doped ZK magnesium alloy, 0.5% to 5% dopant by weight of the doped ZK magnesium alloy, and 0% to 10% of supplemental material by weight of the doped ZK magnesium alloy.

In other embodiments, the doped ZK magnesium alloy comprises 58% to 98.95% of magnesium by weight of the doped ZK magnesium alloy, 3% to 8% of zinc by weight of the doped ZK magnesium alloy, 0.01% to 5% of zirconium by weight of the doped ZK magnesium alloy, 0.05% to 15% dopant by weight of the doped ZK magnesium alloy, and 0% to 10% of supplemental material by weight of the doped ZK magnesium alloy. In some embodiments, the doped ZK magnesium alloy comprises 58% to 98.95% of magnesium by weight of the doped ZK magnesium alloy, 3% to 8% of zinc by weight of the doped ZK magnesium alloy, 0.01% to 5% of zirconium by weight of the doped ZK magnesium alloy, 0.5% to 5% dopant by weight of the doped ZK magnesium alloy, and 0% to 10% of supplemental material by weight of the doped ZK magnesium alloy. The doped ZK magnesium alloy, in other embodiments, comprises 88% to 96% of magnesium by weight of the doped ZK magnesium alloy, 2% to 7% of zinc by weight of the doped ZK magnesium alloy, 0.45% to 3% of zirconium by weight of the doped ZK magnesium alloy, and 0.05% to 5% of dopant by weight of the doped ZK magnesium alloy.

In another embodiment, the doped ZK magnesium alloy comprises about 91.9% magnesium by weight of the doped ZK magnesium alloy, about 5.9% zinc by weight of the doped ZK magnesium alloy, about 0.2% zirconium by weight of the doped ZK magnesium alloy, and about 2% dopant selected from the group consisting of copper, nickel, iron, and any combination thereof by weight of the doped ZK magnesium alloy. In another specific, the doped ZK magnesium alloy for use in the embodiments of the present disclosure comprises 89.9% magnesium by weight of the doped ZK magnesium alloy, 3.2% zinc by weight of the doped ZK magnesium alloy, 0.6% zirconium by weight of the doped ZK magnesium alloy, and 6.3% dopant selected from the group consisting of copper, nickel, iron, and any combination thereof by weight of the doped ZK magnesium alloy.

The doped AM magnesium alloys of the present disclosure may comprise magnesium in an amount in the range of from about 61% to about 97.85% by weight of the doped AM magnesium alloy, encompassing any value and subset therebetween. The doped AM magnesium alloy may further comprise aluminum in an amount in the range of from about 2% to about 10% by weight of the doped AM magnesium alloy, encompassing any value and subset therebetween. The doped AM magnesium alloy may further comprise manganese in an amount in the range of from about 0.1% to about 4% by weight of the doped AM magnesium alloy, encompassing any value and subset therebetween. Additionally, the doped AM magnesium alloy may comprise a dopant in the amount in the range of from about 0.05% to about 15% by weight of the doped AM magnesium alloy. Finally, the doped AM magnesium alloys of the present disclosure may comprise supplementary material, as defined above and discussed below, in an amount in the range of from about 0% to about 10% by weight of the doped AM magnesium alloy, encompassing any value and subset therebetween. That is, in some instances, the doped AM magnesium alloy comprises no supplemental material.

In some embodiments, the doped AM magnesium alloy comprises 61% to 97.85% of magnesium by weight of the doped AM magnesium alloy, 2% to 10% of aluminum by weight of the doped magnesium alloy, 0.1% to 4% of manganese by weight of the doped AM magnesium alloy, 0.05% to 15% of dopant by weight of the doped AM magnesium alloy, and 0% to 10% of supplemental material by weight of the doped AM magnesium alloy. In some embodiments, a specific example of a doped AM magnesium alloy for use in the embodiments of the present disclosure comprises 61% to 97.85% of magnesium by weight of the doped AM magnesium alloy, 2% to 10% of aluminum by weight of the doped magnesium alloy, 0.1% to 4% of manganese by weight of the doped AM magnesium alloy, 0.05% to 5% of dopant by weight of the doped AM magnesium alloy, and 0% to 10% of supplemental material by weight of the doped AM magnesium alloy. In other embodiments, the doped AM magnesium alloy comprises 87% to 97.85% of magnesium by weight of the doped AM magnesium alloy, 2% to 10% of aluminum by weight of the doped magnesium alloy, 0.1% to 4% of manganese by weight of the doped AM magnesium alloy, 0.5% to 5% of dopant by weight of the doped AM magnesium alloy, and 0% to 10% of supplemental material by weight of the doped AM magnesium alloy.

In another specific embodiment, the doped AM magnesium alloy for used in the embodiments of the present disclosure comprises about 91.4% magnesium by weight of the doped AM magnesium alloy, about 6% of aluminum by weight of the doped AM magnesium alloy, about 0.2% manganese by weight of the doped AM magnesium alloy, about 2% dopant selected from the group consisting of copper, nickel, iron, and any combination thereof by weight of the doped AM magnesium alloy, about 0.2% supplemental material of silicon by weight of the doped AM magnesium alloy, and about 0.2% supplemental material of zinc by weight of the doped AM magnesium alloy.

The various supplemental materials that may be included in the doped magnesium alloys described herein, may be natural reaction products or raw material carryover. Examples of such natural supplemental materials may include, but are not limited to, oxides (e.g., magnesium oxide), nitrides (e.g., magnesium nitride), sodium, potassium, hydrogen, and the like, and any combination thereof. In other embodiments, the supplemental materials may be intentionally included in the doped magnesium alloys described herein to impart a desired quality. For example, in some embodiments, the intentionally included supplemental materials may include, but are not limited to, a reinforcing agent, a corrosion retarder, a corrosion accelerant, a reinforcing agent (i.e., to increase strength or stiffness, including, but not limited to, a fiber, a particulate, a fiber weave, and the like, and combinations thereof), silicon, calcium, lithium, manganese, tin, lead, thorium, zirconium, beryllium, cerium, praseodymium, yttrium, and the like, and any combination thereof. Although some of these supplementary materials overlap with the primary elements of a particular doped magnesium alloy, they are not considered supplementary materials unless they are not a primary element of the doped magnesium alloy in which they are included. These intentionally placed supplemental materials may, among other things, provide enhance the mechanical properties of the doped magnesium alloy into which they are included.

Each value for the primary elements of the doped magnesium alloys, dopant, and supplemental material described above is critical for use in the embodiments of the present disclosure and may depend on a number of factors including, but not limited to, the type of downhole tool and component (s) formed from the doped magnesium alloy, the type and amount of dopant selected, the inclusion and type of supplemental material, the amount of supplemental material, the desired degradation rate, the conditions of the subterranean formation in which the downhole tool is used, and the like.

In some embodiments, the rate of degradation of the doped magnesium alloys described herein may be in the range of from about 1% to about 100% of its total mass per about 24 hours in a 3% electrolyte solution (e.g., potassium chloride in an aqueous fluid) at about 93° C. (200° F.). In other embodiments, the dissolution rate of the doped magnesium alloy may be in the range of from about 1 milligram per square centimeter ($mg/cm^2$) to about 2000 $mg/cm^2$ per about one hour in a 15% electrolyte solution (e.g., a halide salt, such as potassium chloride or sodium chloride, in an aqueous fluid) at about 93° C. (200° F.), encompassing any value and subset therebetween.

It will be appreciated by one of skill in the art that the well system 110 of FIG. 1 is merely one example of a wide variety of well systems in which the principles of the present disclosure may be utilized. Accordingly, it will be appreciated that the principles of this disclosure are not necessarily limited to any of the details of the depicted well system 110, or the various components thereof, depicted in the drawings or otherwise described herein. For example, it is not necessary in keeping with the principles of this disclosure for the wellbore 120 to include a generally vertical cased section. The well system 110 may equally be employed in vertical and/or deviated wellbores, without departing from the scope of the present disclosure. Furthermore, it is not necessary for a single downhole tool 100 to be suspended from the tool string 118.

In addition, it is not necessary for the downhole tool 100 to be lowered into the wellbore 120 using the derrick 112. Rather, any other type of device suitable for lowering the downhole tool 100 into the wellbore 120 for placement at a desired location, or use therein to perform a downhole operation may be utilized without departing from the scope of the present disclosure such as, for example, mobile workover rigs, well servicing units, and the like. Although not depicted, the downhole tool 100 may alternatively be hydraulically pumped into the wellbore and, thus, not need the tool string 118 for delivery into the wellbore 120.

Figure 2:
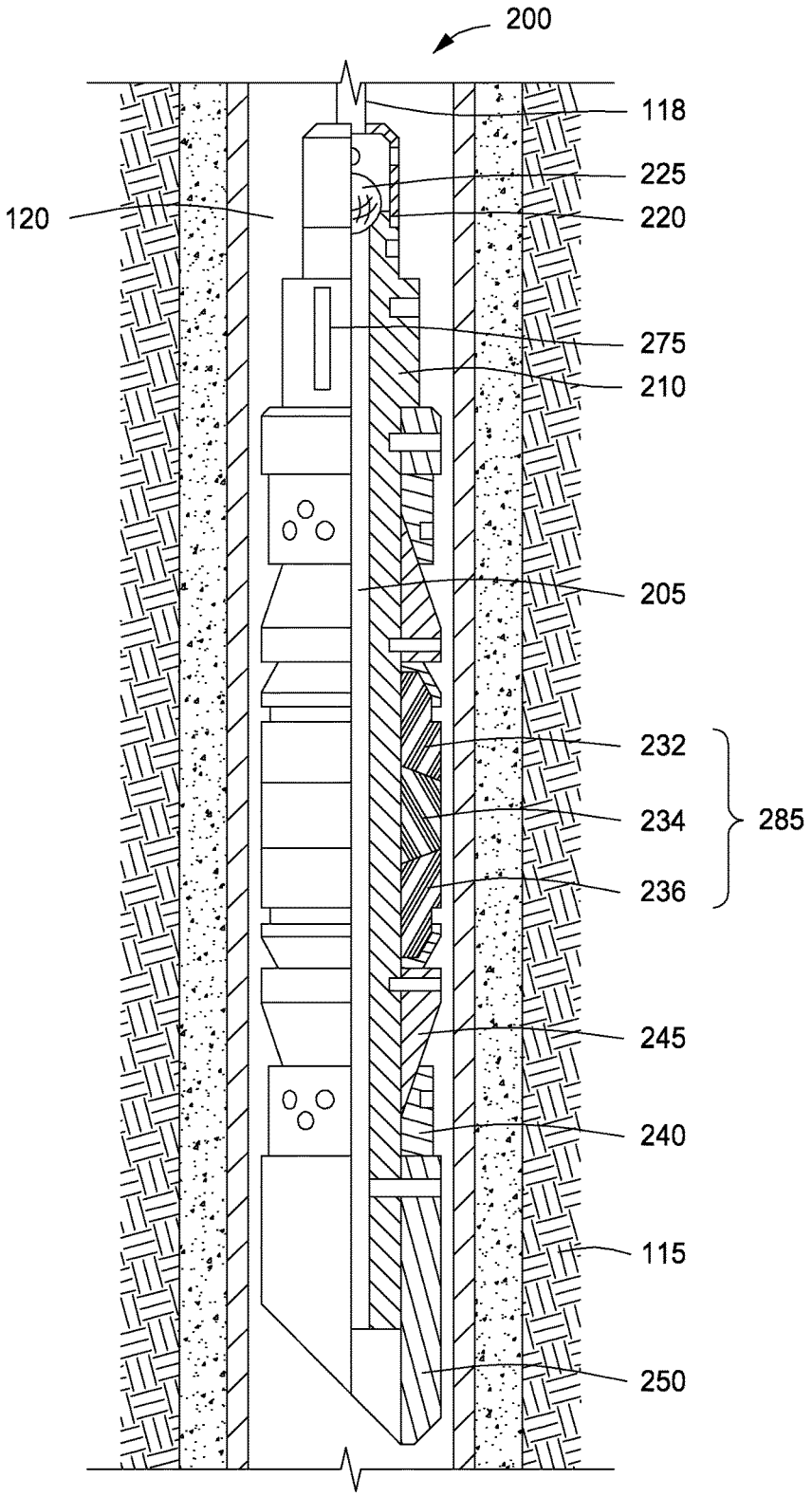
FIG. 2 illustrates a cross-sectional view of an exemplary downhole tool that can employ one or more principles of the present disclosure, according to one or more embodiments.

Referring now to FIG. 2, with continued reference to FIG. 1, one specific type of downhole tool 100 described herein is a frac plug wellbore isolation device for use during a well stimulation/fracturing operation. FIG. 2 illustrates a cross-sectional view of an exemplary frac plug 200 being lowered into a wellbore 120 on a tool string 118. As previously mentioned, the frac plug 200 generally comprises a body 210 and a sealing element 285. The sealing element 285, as depicted, comprises an upper sealing element 232, a center sealing element 234, and a lower sealing element 236. It will be appreciated that although the sealing element 285 is shown as having three portions (i.e., the upper sealing element 232, the center sealing element 234, and the lower sealing element 236), any other number of portions, or a single portion, may also be employed without departing from the scope of the present disclosure.

As depicted, the sealing element 285 is extending around the body 210; however, it may be of any other configuration suitable for allowing the sealing element 285 to form a fluid seal in the wellbore 120, without departing from the scope of the present disclosure. For example, in some embodiments, the body may comprise two sections joined together by the sealing element, such that the two sections of the body compress to permit the sealing element to make a fluid seal in the wellbore 120. Other such configurations are also suitable for use in the embodiments described herein. Moreover, although the sealing element 285 is depicted as located in a center section of the body 210, it will be appreciated that it may be located at any location along the length of the body 210, without departing from the scope of the present disclosure.

The body 210 of the frac plug 200 comprises an axial flowbore 205 extending therethrough. A cage 220 is formed at the upper end of the body 210 for retaining a ball 225 that acts as a one-way check valve. In particular, the ball 225 seals off the flowbore 205 to prevent flow downwardly therethrough, but permits flow upwardly through the flowbore 205. One or more slips 240 are mounted around the body 210 below the sealing element 285. The slips 240 are guided by a mechanical slip body 245. A tapered shoe 250 is provided at the lower end of the body 210 for guiding and protecting the frac plug 200 as it is lowered into the wellbore 120. An optional enclosure 275 for storing a chemical solution may also be mounted on the body 210 or may be formed integrally therein. In one embodiment, the enclosure 275 is formed of a frangible material.

Either or both of the body 210 and the sealing element 285 may be composed at least partially of a doped magnesium alloy described herein. Moreover, components of either or both of the body 210 and the sealing element 285 may be composed of one or more of the doped magnesium alloys. For example, one or more of the cage 220, the ball 225, the slips 240, the mechanical slip body 245, the tapered shoe 250, or the enclosure 275 may be formed from the same or a different type of doped magnesium alloy, without departing from the scope of the present disclosure. Moreover, although components of a downhole tool 100 (FIG. 1) are explained herein with reference to a frac plug 200, other downhole tools and components thereof may be formed from a doped magnesium alloy having the compositions described herein without departing from the scope of the present disclosure.

In some embodiments, the doped magnesium alloys forming a portion of the downhole tool 100 (FIG. 1) may be at least partially encapsulated in a second material (e.g., a "sheath") formed from an encapsulating material capable of protecting or prolonging degradation of the doped magnesium alloy (e.g., delaying contact with an electrolyte). The sheath may also serve to protect the sealing downhole tool 100 from abrasion within the wellbore 120. The structure of the sheath may be permeable, frangible, or of a material that is at least partially removable at a desired rate within the wellbore environment. The encapsulating material forming the sheath may be any material capable of use in a downhole environment and, depending on the structure of the sheath. For example, a frangible sheath may break as the downhole tool 100 is placed at a desired location in the wellbore 120 or as the downhole tool 100 is actuated, if applicable, whereas a permeable sheath may remain in place on the sealing element 285 as it forms the fluid seal. As used herein, the term "permeable" refers to a structure that permits fluids (including liquids and gases) therethrough and is not limited to any particular configuration. Suitable encapsulating materials may include, but are not limited to, a wax, a drying oil, a polyurethane, a crosslinked partially hydrolyzed polyacrylic, a silicate material, a glass material, an inorganic durable material, a polymer, a polylactic acid, a polyvinyl alcohol, a polyvinylidene chloride, an elastomer, a thermoplastic, and any combination thereof.

Referring again to FIG. 1, removing the downhole tool 100, described herein from the wellbore 120 is more cost effective and less time consuming than removing conventional downhole tools, which require making one or more trips into the wellbore 120 with a mill or drill to gradually grind or cut the tool away. Instead, the downhole tools 100 described herein are removable by simply exposing the tools 100 to an introduced electrolyte fluid or a produced (i.e., naturally occurring by the formation) electrolyte fluid in the downhole environment. The foregoing descriptions of specific embodiments of the downhole tool 100, and the systems and methods for removing the biodegradable tool 100 from the wellbore 120 have been presented for purposes of illustration and description and are not intended to be exhaustive or to limit this disclosure to the precise forms disclosed. Many other modifications and variations are possible. In particular, the type of downhole tool 100, or the particular components that make up the downhole tool 100 (e.g., the body and sealing element) may be varied. For example, instead of a frac plug 200 (FIG. 2), the downhole tool 100 may comprise a bridge plug, which is designed to seal the wellbore 120 and isolate the zones above and below the bridge plug, allowing no fluid communication in either direction. Alternatively, the degradable downhole tool 100 could comprise a packer that includes a shiftable valve such that the packer may perform like a bridge plug to isolate two formation zones, or the shiftable valve may be opened to enable fluid communication therethrough. Similarly, the downhole tool 100 could comprise a wiper plug or a cement plug or any other downhole tool having a variety of components.

While various embodiments have been shown and described herein, modifications may be made by one skilled in the art without departing from the scope of the present disclosure. The embodiments described here are exemplary only, and are not intended to be limiting. Many variations, combinations, and modifications of the embodiments disclosed herein are possible and are within the scope of the disclosure. Accordingly, the scope of protection is not limited by the description set out above, but is defined by the claims which follow, that scope including all equivalents of the subject matter of the claims.

Embodiments disclosed herein include Embodiment A, Embodiment B, and Embodiment C:

Embodiment A: A downhole tool comprising: at least one component of the downhole tool made of a doped magnesium alloy solid solution that at least partially degrades in the presence of an electrolyte, wherein the doped magnesium alloy is selected from the group consisting of: a doped MG magnesium alloy comprising about 85% to about 99.95% magnesium and about 0.05% to about 15% dopant, each by weight of the doped MG magnesium alloy; a doped WE magnesium alloy comprising about 40% to about 98.95% magnesium, about 1% to about 15% rare earth metal, and about 0.05% to about 15% dopant, each by weight of the doped WE magnesium alloy; a doped AZ magnesium alloy comprising about 57.3% to about 98.85% magnesium, about 1% to about 12.7% aluminum, about 0.1% to about 5% zinc, and about 0.05% to about 15% dopant, each by weight of the doped AZ magnesium alloy; a doped ZK magnesium alloy comprising about 58% to about 98.95% magnesium, about 1% to about 12% zinc, about 0.01% to about 5% zirconium, and about 0.05% to about 15% dopant, each by weight of the doped ZK magnesium alloy; a doped AM magnesium alloy comprising about 61% to about 97.85% magnesium, about 2% to about 10% aluminum, about 0.1% to about 4% manganese, and about 0.05% to about 15% dopant, each by weight of the doped AM magnesium alloy; and any combination thereof.

Embodiment B: A method comprising: introducing a downhole tool comprising at least one component made of a doped magnesium alloy solid solution into a subterranean formation; performing a downhole operation; and degrading at least a portion of the doped magnesium alloy solid solution in the subterranean formation by contacting the doped magnesium alloy solid solution with an electrolyte, wherein the doped magnesium alloy is selected from the group consisting of: a doped MG magnesium alloy comprising about 85% to about 99.95% magnesium and about 0.05% to about 15% dopant, each by weight of the doped MG magnesium alloy; a doped WE magnesium alloy comprising about 40% to about 98.95% magnesium, about 1% to about 15% rare earth metal, and about 0.05% to about 15% dopant, each by weight of the doped WE magnesium alloy; a doped AZ magnesium alloy comprising about 57.3% to about 98.85% magnesium, about 1% to about 12.7% aluminum, about 0.1% to about 5% zinc, and about 0.05% to about 15% dopant, each by weight of the doped AZ magnesium alloy; a doped ZK magnesium alloy comprising about 58% to about 98.95% magnesium, about 1% to about 12% zinc, about 0.01% to about 5% zirconium, and about 0.05% to about 15% dopant, each by weight of the doped ZK magnesium alloy; a doped AM magnesium alloy comprising about 61% to about 97.85% magnesium, about 2% to about 10% aluminum, about 0.1% to about 4% manganese, and about 0.05% to about 15% dopant, each by weight of the doped AM magnesium alloy; and any combination thereof.

Embodiment C: A system comprising: a tool string connected to a derrick and extending through a surface into a wellbore in a subterranean formation; and a downhole tool connected to the tool string and placed in the wellbore, the downhole tool comprising at least one component made of a doped magnesium alloy solid solution that at least partially degrades in the presence of an electrolyte, wherein the doped magnesium alloy is selected from the group consisting of: a doped MG magnesium alloy comprising about 85% to about 99.95% magnesium and about 0.05% to about 15% dopant, each by weight of the doped MG magnesium alloy; a doped WE magnesium alloy comprising about 40% to about 98.95% magnesium, about 1% to about 15% rare earth metal, and about 0.05% to about 15% dopant, each by weight of the doped WE magnesium alloy; a doped AZ magnesium alloy comprising about 57.3% to about 98.85% magnesium, about 1% to about 12.7% aluminum, about 0.1% to about 5% zinc, and about 0.05% to about 15% dopant, each by weight of the doped AZ magnesium alloy; a doped ZK magnesium alloy comprising about 58% to about 98.95% magnesium, about 1% to about 12% zinc, about 0.01% to about 5% zirconium, and about 0.05% to about 15% dopant, each by weight of the doped ZK magnesium alloy; a doped AM magnesium alloy comprising about 61% to about 97.85% magnesium, about 2% to about 10% aluminum, about 0.1% to about 4% manganese, and about 0.05% to about 15% dopant, each by weight of the doped AM magnesium alloy; and any combination thereof.

Each of Embodiments A, B, and C may have one or more of the following additional elements in any combination:

Element 1: Wherein the dopant is selected from the group consisting of iron, copper, nickel, chromium, cobalt, carbon, silver, gold, palladium, and any combination thereof.

Element 2: Wherein the doped magnesium alloy is selected from the group consisting of the doped MG magnesium alloy, the doped WE magnesium alloy, the doped AZ magnesium alloy, the doped ZK magnesium alloy, the doped AM magnesium alloy, and any combination thereof, and further comprises a supplemental material present in an amount of less than about 10% by weight of the doped magnesium alloy.

Element 3: Wherein the doped magnesium alloy is selected from the group consisting of the doped MG magnesium alloy, the doped WE magnesium alloy, the doped AZ magnesium alloy, the doped ZK magnesium alloy, the doped AM magnesium alloy, and any combination thereof, and comprises 0.5% to 5% dopant.

Element 4: Wherein the rare earth metal in the doped WE magnesium alloy is selected from the group consisting of scandium, lanthanum, cerium, praseodymium, neodymium, promethium, samarium, europium, gadolinium, dysprosium, holmium, erbium, thulium, ytterbium, lutetium, yttrium, and any combination thereof.

Element 5: Wherein the doped WE magnesium alloy comprises 86.6% to 90.6% magnesium, about 4% rare earth metal yttrium, about 4% rare earth metal that is not yttrium, 1% to about 5% dopant selected from the group consisting of iron, nickel, copper, and any combination thereof, and about 0.4% supplemental material of zirconium, each by weight of the doped WE magnesium alloy.

Element 6: Wherein the doped AZ magnesium alloy comprises 3% to 10% aluminum.

Element 7: Wherein the doped AZ magnesium alloy comprises 0.01 to 3% zinc.

Element 8: Wherein the doped AZ magnesium alloy comprises 3% to 10% aluminum and 0.01% to 3% zinc.

Element 9: Wherein the doped AZ magnesium alloy comprises about 88.5% magnesium, about 9% aluminum, about 0.7% zinc, 1% to about 5% dopant selected from the group consisting of iron, nickel, copper, and any combination thereof, about 0.2% supplemental material of manganese, and about 0.3% supplemental material of zinc, each by weight of the doped AZ magnesium alloy.

Element 10: Wherein the doped AZ magnesium alloy comprises about 94.5% magnesium, about 3% aluminum, about 1% zinc, 1% to about 5% dopant selected from the group consisting of iron, nickel, copper and any combination thereof, and about 0.3% supplemental material of manganese, each by weight of the doped AZ magnesium alloy.

Element 12: Wherein the doped ZK magnesium alloy comprises 3% to 8% zinc.

Element 12: Wherein the doped ZK magnesium alloy comprises about 91.7% magnesium, about 5.9% zinc, about 0.2% zirconium, and about 2% dopant selected from the group consisting of copper, nickel, iron, and any combination thereof, each by weight of the doped ZK magnesium alloy.

Element 13: Wherein the doped ZK magnesium alloy comprises about 89.9% magnesium, about 3.2% zinc, about 0.6% zirconium, and about 6.3% dopant selected from the group consisting of copper, nickel, iron, and any combination thereof, each by weight of the doped ZK magnesium alloy.

Element 14: Wherein the doped AM magnesium alloy comprises about 91.4% magnesium, about 6% aluminum, about 0.2% manganese, about 2% dopant selected from the group consisting of copper, nickel, iron, and any combination thereof, about 0.2% supplemental material of silicon, and about 0.2% supplemental material of zinc, each by weight of the doped AM magnesium alloy.

Element 15: Wherein the downhole tool is selected from the group consisting of a wellbore isolation device, a completion tool, a drill tool, a testing tool, a slickline tool, a wireline tool, an autonomous tool, a tubing conveyed perforating tool, and any combination thereof.

Element 16: Wherein the downhole tool is a wellbore isolation device, the wellbore isolation device being a frac plug or a frac ball.

Element 17: Wherein the at least one component is selected from the group consisting of a mandrel of a packer or plug, a spacer ring, a slip, a wedge, a retainer ring, an extrusion limiter or backup shoe, a mule shoe, a ball, a flapper, a ball seat, a sleeve, a perforation gun housing, a cement dart, a wiper dart, a sealing element, a wedge, a slip block, a logging tool, a housing, a release mechanism, a pumpdown tool, an inflow control device plug, an autonomous inflow control device plug, a coupling, a connector, a support, an enclosure, a cage, a slip body, a tapered shoe, and any combination thereof.

Element 18: Wherein at least a portion of the doped magnesium alloy solid solution is degradable upon contact with an electrolyte, and the electrolyte is selected from the group consisting of an introduced electrolyte into the subterranean formation, a produced electrolyte by the subterranean formation, and any combination thereof.

Element 19: Wherein the downhole tool is used in a downhole operation, the downhole operation is selected from the group consisting of a stimulation operation, an acidizing operation, an acid-fracturing operation, a sand control operation, a fracturing operation, a frac-packing operation, a remedial operation, a perforating operation, a near-wellbore consolidation operation, a drilling operation, a completion operation, and any combination thereof.

By way of non-limiting example, exemplary combinations applicable to Embodiments A, B, and/or C include: 1, 2, and 6; 14, 15, 17, and 19; 3, 5, 9, and 10; 12, 13, 16, 18, and 19; 4, 9, and 11; 2, 5, 6, 8, and 15; and the like.

To facilitate a better understanding of the embodiments of the present disclosure, the following example is given. In no way should the following example be read to limit, or to define, the scope of the disclosure.

EXAMPLE

Figure 3:
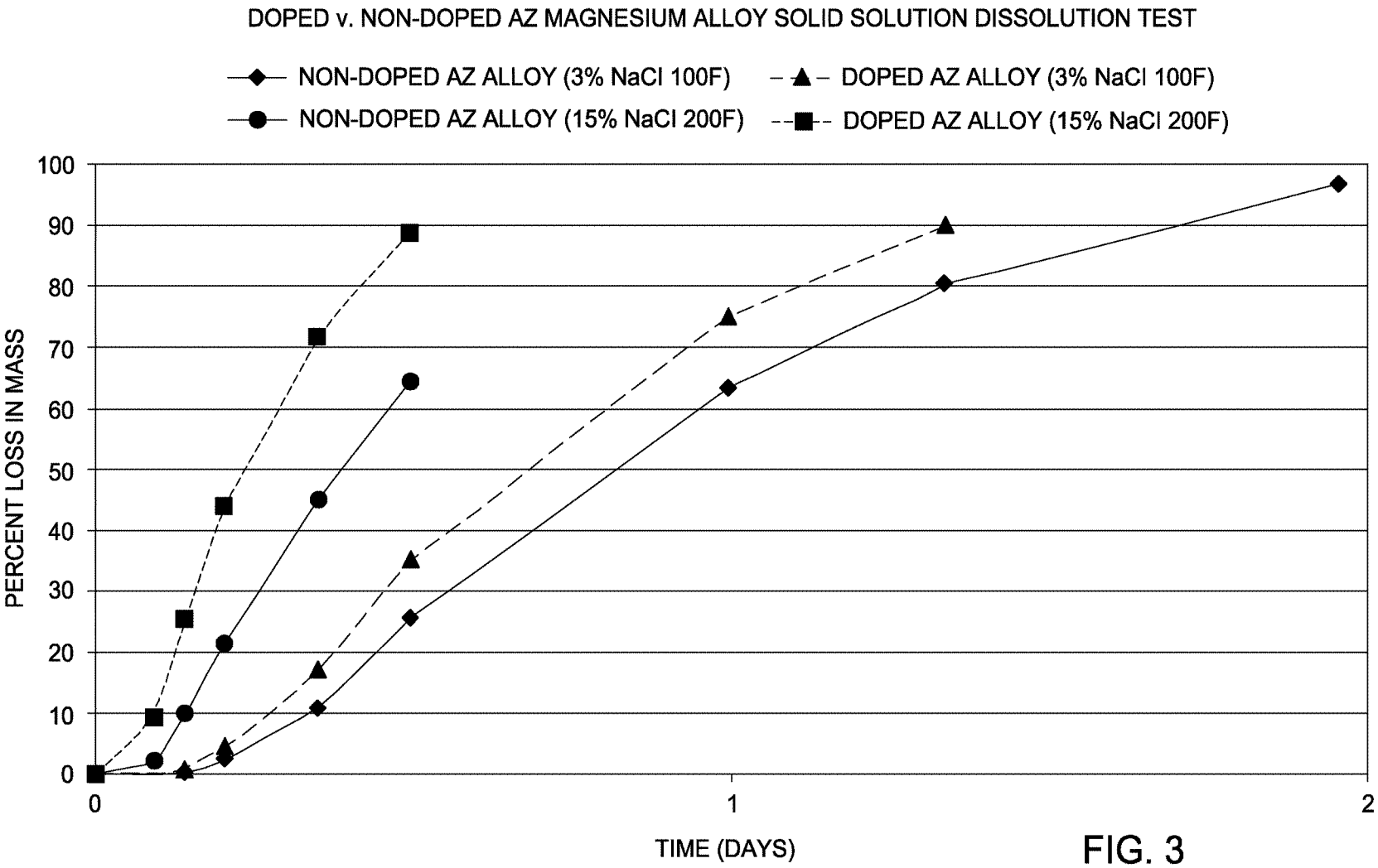
FIG. 3 illustrates the degradation rate of a doped magnesium alloy solid solution, according to one or more embodiments of the present disclosure.

In this example, the degradation rate of a doped AZ magnesium alloy, as described herein, was compared to the degradation rate of non-doped AZ magnesium alloy. Specifically, each of the doped and non-doped AZ magnesium alloys were placed in an electrolyte solution of 3% sodium chloride in fresh water and incubated at about 38° C. (100° F.), or placed in an electrolyte solution of 15% sodium chloride in fresh water and incubated at about 93° C. (200° F.) to determine dissolution (i.e., degradation) rate. The dissolution rate was measured by determining the percent loss in mass for each of the doped AZ magnesium alloy and the non-doped AZ magnesium alloy and were measured until mass measurements could no longer be attained. The non-doped AZ magnesium alloy was composed of 90.5% magnesium, 9% aluminum, and 0.5% zinc. The doped AZ magnesium alloy was composed of 90.45% magnesium, 9% aluminum, 0.5% zinc, and 0.05% iron dopant. The results are illustrated in FIG. 3.

As shown, the rate of degradation of the doped AZ magnesium alloy was faster than the non-doped AZ magnesium alloy counterparts, in both conditions tested. For example, in the 3% electrolyte solution at about 38° C., after the elapse of about 24 hours the non-doped AZ magnesium alloy lost about 63% of its mass and the doped AZ magnesium alloy lost about 75% of its mass; similarly after the elapse of about 32 hours (1.3 days) the non-doped AZ magnesium alloy lost about 80% of its mass whereas the doped AZ magnesium alloy lost about 90% of its mass. With respect to the 15% electrolyte solution at about 93° C., after the elapse of about 8 hours the non-doped AZ magnesium alloy lost about 45% of its mass and the doped AZ magnesium alloy lost about 72% of its mass; similarly after the elapse of about 12 hours the non-doped AZ magnesium alloy lost about 64% of its mass whereas the doped AZ magnesium alloy lost about 89% of its mass.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

What is claimed is:

1. A downhole tool comprising:

at least one component of the downhole tool made of a doped magnesium alloy solid solution formed from a single melt that at least partially degrades in the presence of an electrolyte, wherein the doped magnesium alloy is selected from the group consisting of:

a doped WE magnesium alloy comprising 86.6% to 90.6% magnesium, about 4% rare earth metal yttrium, about 4% rare earth metal that is not yttrium, 1% to about 5% dopant from the group consisting of iron, nickel, copper, and any combination thereof, and selected about 0.4% supplemental material of zirconium, each by weight of the doped WE magnesium alloy;

a doped AZ magnesium alloy comprising about 88.5% magnesium, about 9% aluminum, about 0.7% zinc, 1% to about 5% dopant selected from the group consisting of iron, nickel, copper, and any combination thereof, about 0.2% supplemental material of manganese, and about 0.3% supplemental material of zinc, each by weight of the doped AZ magnesium alloy;

a doped AZ magnesium alloy comprises about 94.5% magnesium, about 3% aluminum, about 1% zinc, 1% to about 5% dopant selected from the group consisting of iron, nickel, copper and any combination thereof, and about 0.3% supplemental material of manganese, each by weight of the doped AZ magnesium alloy;

a doped ZK magnesium alloy comprising about 91.7% magnesium, about 5.9% zinc, about 0.2% zirconium, and about 2% dopant selected from the group consisting of copper, nickel, iron, and any combination thereof, each by weight of the doped ZK magnesium alloy;

a doped ZK magnesium alloy comprising about 89.9% magnesium, about 3.2% zinc, about 0.6% zirconium, and about 6.3% dopant selected from the group consisting of copper, nickel, iron, and any combination thereof, each by weight of the doped ZK magnesium alloy; and a doped AM magnesium alloy comprising about 91.4% magnesium, about 6% aluminum, about 0.2% manganese, about 2% dopant selected from the group consisting of copper, nickel, iron, and any combination thereof, about 0.2% supplemental material of silicon, and about 0.2% supplemental material of zinc, each by weight of the doped AM magnesium alloy.

2. The downhole tool of claim 1, wherein the doped magnesium alloy is selected from the group consisting of the doped AZ magnesium alloy and the doped ZK magnesium alloy.

3. The downhole tool of claim 1, wherein the doped magnesium alloy is selected from the group consisting of the doped WE magnesium alloy, the doped AZ magnesium alloy, the doped ZK magnesium alloy, the doped AM magnesium alloy, and any combination thereof, and further comprises a supplemental material present in an amount of less than about 10% by weight of the doped magnesium alloy.

4. The downhole tool of claim 1, wherein the doped magnesium alloy is selected from the group consisting of the doped WE magnesium alloy, the doped AZ magnesium alloy, the doped ZK magnesium alloy, the doped AM magnesium alloy, and any combination thereof, and comprises 0.5% to 5% dopant.

5. The downhole tool of claim 1, wherein the rare earth metal in the doped WE magnesium alloy that is not yttrium is selected from the group consisting of scandium, lanthanum, cerium, praseodymium, neodymium, promethium, samarium, europium, gadolinium, dysprosium, holmium, erbium, thulium, ytterbium, lutetium, and any combination thereof.

6. The downhole tool of claim 1, wherein the downhole tool is selected from the group consisting of a wellbore isolation device, a completion tool, a drill tool, a testing tool, a slickline tool, a wireline tool, an autonomous tool, a tubing conveyed perforating tool, and any combination thereof.

7. The downhole tool of claim 1, wherein the downhole tool is a wellbore isolation device, the wellbore isolation device being a frac plug or a frac ball.

8. The downhole tool of claim 1, wherein the at least one component is selected from the group consisting of a mandrel of a packer or plug, a spacer ring, a slip, a wedge, a retainer ring, an extrusion limiter or backup shoe, a mule shoe, a ball, a flapper, a ball seat, a sleeve, a perforation gun housing, a cement dart, a wiper dart, a sealing element, a wedge, a slip block, a logging tool, a housing, a release mechanism, a pumpdown tool, an inflow control device plug, an autonomous inflow control device plug, a coupling, a connector, a support, an enclosure, a cage, a slip body, a tapered shoe, and any combination thereof.

9. A method comprising:

introducing a downhole tool comprising at least one component made of a doped magnesium alloy solid solution formed from a single melt into a subterranean formation;

performing a downhole operation; and degrading at least a portion of the doped magnesium alloy solid solution in the subterranean formation by contacting the doped magnesium alloy solid solution with an electrolyte, wherein the doped magnesium alloy is selected from the group consisting of:

a doped WE magnesium alloy comprising 86.6% to 90.6% magnesium, about 4% rare earth metal yttrium, about 4% rare earth metal that is not yttrium, 1% to about 5% dopant selected from the group consisting of iron, nickel, copper, and any combination thereof, and about 0.4% supplemental material of zirconium, each by weight of the doped WE magnesium alloy;

a doped AZ magnesium alloy comprising about 88.5% magnesium, about 9% aluminum, about 0.7% zinc, 1% to about 5% dopant selected from the group consisting of iron, nickel, copper, and any combination thereof, about 0.2% supplemental material of manganese, and about 0.3% supplemental material of zinc, each by weight of the doped AZ magnesium alloy;

a doped AZ magnesium alloy comprises about 94.5% magnesium, about 3% aluminum, about 1% zinc, 1% to about 5% dopant selected from the group consisting of iron, nickel, copper and any combination thereof, and about 0.3% supplemental material of manganese, each by weight of the doped AZ magnesium alloy;

a doped ZK magnesium alloy comprising about 91.7% magnesium, about 5.9% zinc, about 0.2% zirconium, and about 2% dopant selected from the group consisting of copper, nickel, iron, and any combination thereof, each by weight of the doped ZK magnesium alloy;

a doped ZK magnesium alloy comprising about 89.9% magnesium, about 3.2% zinc, about 0.6% zirconium, and about 6.3% dopant selected from the group consisting of copper, nickel, iron, and any combination thereof, each by weight of the doped ZK magnesium alloy; and a doped AM magnesium alloy comprising about 91.4% magnesium, about 6% aluminum, about 0.2% manganese, about 2% dopant selected from the group consisting of copper, nickel, iron, and any combination thereof, about 0.2% supplemental material of silicon, and about 0.2% supplemental material of zinc, each by weight of the doped AM magnesium alloy.

10. The method of claim 9, wherein the electrolyte is selected from the group consisting of an introduced electrolyte into the subterranean formation, a produced electrolyte by the subterranean formation, and any combination thereof.

11. The method of claim 9, wherein the downhole operation is selected from the group consisting of a stimulation operation, an acidizing operation, an acid-fracturing operation, a sand control operation, a fracturing operation, a frac-packing operation, a remedial operation, a perforating operation, a near-wellbore consolidation operation, a drilling operation, a completion operation, and any combination thereof.

12. The method of claim 9, wherein the downhole tool is selected from the group consisting of a wellbore isolation device, a completion tool, a drill tool, a testing tool, a slickline tool, a wireline tool, an autonomous tool, a tubing conveyed perforating tool, and any combination thereof.

13. The method of claim 9, wherein the downhole tool is a wellbore isolation device, the wellbore isolation device being a frac plug or a frac ball.

14. The method of claim 9, wherein the at least one component is selected from the group consisting of a mandrel of a packer or plug, a spacer ring, a slip, a wedge, a retainer ring, an extrusion limiter or backup shoe, a mule shoe, a ball, a flapper, a ball seat, a sleeve, a perforation gun housing, a cement dart, a wiper dart, a sealing element, a wedge, a slip block, a logging tool, a housing, a release mechanism, a pumpdown tool, an inflow control device plug, an autonomous inflow control device plug, a coupling, a connector, a support, an enclosure, a cage, a slip body, a tapered shoe, and any combination thereof.

15. A system comprising:

a tool string connected to a derrick and extending through a surface into a wellbore in a subterranean formation; and a downhole tool connected to the tool string and placed in the wellbore, the downhole tool comprising at least one component made of a doped magnesium alloy solid solution formed from a single melt that at least partially degrades in the presence of an electrolyte, wherein the doped magnesium alloy is selected from the group consisting of:

a doped WE magnesium alloy comprising 86.6% to 90.6% magnesium, about 4% rare earth metal yttrium, about 4% rare earth metal that is not yttrium, 1% to about 5% dopant selected from the group consisting of iron, nickel, copper, and any combination thereof, and about 0.4% supplemental material of zirconium, each by weight of the doped WE magnesium alloy;

a doped AZ magnesium alloy comprising about 88.5% magnesium, about 9% aluminum, about 0.7% zinc, 1% to about 5% dopant selected from the group consisting of iron, nickel, copper, and any combination thereof, about 0.2% supplemental material of manganese, and about 0.3% supplemental material of zinc, each by weight of the doped AZ magnesium alloy;

a doped AZ magnesium alloy comprises about 94.5% magnesium, about 3% aluminum, about 1% zinc, 1% to about 5% dopant selected from the group consisting of iron, nickel, copper and any combination thereof, and about 0.3% supplemental material of manganese, each by weight of the doped AZ magnesium alloy;

a doped ZK magnesium alloy comprising about 91.7% magnesium, about 5.9% zinc, bout 0.2% zirconium, and about 2% dopant selected from the group consisting of copper, nickel, iron, and any combination thereof, each by weight of the doped ZK magnesium alloy;

a doped ZK magnesium alloy comprising about 89.9% magnesium, about 3.2% zinc, about 0.6% zirconium, and about 6.3% dopant selected from the group consisting of copper, nickel, iron, and any combination thereof, each by weight of the doped ZK magnesium alloy; and a doped AM magnesium alloy comprising about 91.4% magnesium, about 6% aluminum, about 0.2% manganese, about 2% dopant selected from the group consisting of copper, nickel, iron, and any combination thereof, about 0.2% supplemental material of silicon, and about 0.2% supplemental material of zinc, each by weight of the doped AM magnesium alloy.

16. The system of claim 15, wherein the electrolyte is selected from the group consisting of an introduced electrolyte into the subterranean formation, a produced electrolyte by the subterranean formation, and any combination thereof.

17. The system of claim 15, wherein the downhole tool is selected from the group consisting of a wellbore isolation device, a completion tool, a drill tool, a testing tool, a slickline tool, a wireline tool, an autonomous tool, a tubing conveyed perforating tool, and any combination thereof.

18. The system of claim 15, wherein the downhole tool is a wellbore isolation device, the wellbore isolation device being a frac plug or a frac ball.

19. The system of claim 15, wherein the at least one component is selected from the group consisting of a mandrel of a packer or plug, a spacer ring, a slip, a wedge, a retainer ring, an extrusion limiter or backup shoe, a mule shoe, a ball, a flapper, a ball seat, a sleeve, a perforation gun housing, a cement dart, a wiper dart, a sealing element, a wedge, a slip block, a logging tool, a housing, a release mechanism, a pumpdown tool, an inflow control device plug, an autonomous inflow control device plug, a coupling, a connector, a support, an enclosure, a cage, a slip body, a tapered shoe, and any combination thereof.

* * * * *